United States Patent [19]

Pugh et al.

[11] 4,274,224

[45] Jun. 23, 1981

[54] TOY FIGURE HAVING MOVABLE LIMB MEMBERS

[75] Inventors: William A. G. Pugh, Anstey; Robert I. Edmunds, Barwell; Peter B. Mansell, Hinckley; Robert Brechin, Thringstone; Hubert A. Langton, Leicester, all of England

[73] Assignee: CPG Products Corp., Minneapolis, Minn.

[21] Appl. No.: 961,450

[22] Filed: Nov. 17, 1978

[30] Foreign Application Priority Data

Nov. 21, 1977 [GB] United Kingdom ..... 48465/77

[51] Int. Cl.[3] ..... A63H 3/20; A63H 3/46

[52] U.S. Cl. ..... 46/161; 46/173

[58] Field of Search ..... 46/161, 173, 115–120, 46/151, 162, 163

[56] References Cited

U.S. PATENT DOCUMENTS

| | | | |
|---|---|---|---|
| 2,021,115 | 11/1935 | Jackson | 46/161 UX |
| 3,628,282 | 12/1971 | Johnson et al. | 46/161 |
| 3,716,942 | 2/1973 | Garcia et al. | 46/161 |
| 3,988,855 | 11/1976 | Crabtree et al. | 46/161 |

*Primary Examiner*—Gene Mancene
*Assistant Examiner*—Michael J. Foycik
*Attorney, Agent, or Firm*—Gene O. Enockson; L. MeRoy Lillehaugen

[57] ABSTRACT

An articulated toy figure or doll having a torso with limb members attached to it which are readily movable. A skeletal structure is provided for one or more of the limb members, which enables the limb member to be connected to the torso or another limb member, for movement relative thereto. The leg members of the toy figure are connected to the torso by a hip joint in such a manner that such leg members are swingably movable relative to each other, as well as relative to the torso.

16 Claims, 5 Drawing Figures

TOY FIGURE HAVING MOVABLE LIMB MEMBERS

The present invention relates to toy figures, such as a toy doll, and more particularly, it is concerned with the provision of improved limb and limb joint structures for such toy figures.

One well known form of limb joint in a toy figure comprises a first jointing portion formed as an integral terminal portion of one limb member, and a second jointing portion formed at one end of a pin which is an axially rotatable friction fit in a complementary axial bore in the other limb member. The jointing portions may be of various kinds, for example respectively a ball and socket, or respectively a slot and a tongue pivotally mounted therein.

One disadvantage of this kind of construction is that it is inconvenient to mould the first jointing portion as an integral terminal portion of a limb (or hand or foot) member, it being sufficiently difficult to provide that member with a realistic external shape without the added problem of forming a jointing portion on one end of it. Another disadvantage is that it is inconvenient to form such a limb member with an accurately dimensioned bore to receive the pin which mounts the other jointing portion, as a tight but rotatable friction fit. Yet another disadvantage is that it is not possible to achieve a disconnectible friction fit between the said pin and its bore; in other words, the joint is likely to come apart by disengagement of the pin from the bore as a result of wear and tear.

Viewed from one aspect, the present invention provides a skeletal structure for a limb member of a toy figure, including a first element comprising an elongate tubular member having a first jointing portion formed at one end thereof, and a second element comprising an elongate member, one end of which is insertable in the other end of said tubular member and is adapted, when so inserted, automatically to make unwithdrawable engagement with said tubular member whilst being axially rotatable relatively thereto, a second jointing portion being formed at the other end of said second element.

When such a skeletal structure is assembled within an outer tubular shell formed to the desired external shape of a limb member, the jointing portion on the said first element will be located at one end of the assembly for engagement with a jointing portion on another limb member (or on a hand or foot or on the torso) whilst the jointing portion on the second element will be located at the other end for a similar purpose. It will be understood that such an arrangement obviates all of the disadvantages of the prior proposals described above.

The scope of the invention also extends to the respective elements of the said skeletal structure. Thus, viewed from another aspect, the invention provides an element to constitute the said first element of a skeletal structure as set forth above, such element comprising an elongate tubular member having a jointing portion formed at one end thereof, such tubular member being formed with internal abutment means for engagement with an element (i.e., said second element) to be inserted in the other end thereof so as to prevent subsequent withdrawal of such an element whilst permitting relative rotation of the two elements. Viewed from a further aspect, the invention provides an element to constitute the said second element of a skeletal structure as set forth above, such element comprising an elongate member one end of which is insertable in a tubular member and is adapted, when so inserted, automatically to make unwithdrawable engagement with abutment means in said tubular member whilst being axially rotatable relatively thereto, a jointing portion being formed at the other end of said second element.

The said jointing portions may be of any convenient kind. The two such portions in one skeletal structure may be the same, e.g., two balls for respective ball and socket joints, or different, e.g., a ball on one element and a socket on the other, or even of different types, e.g., a ball on one element for a ball and socket joint, and a tongue on the other element for a tongue and slot joint. Preferably however, the jointing portion on said first element includes a slot whose general plane is parallel to the length of the element, for the rotatable reception of another jointing portion in the form of a tongue, whilst the jointing portion on said second element is a tongue whose general plane is parallel to the length of the element, for rotatable reception in a slot of another jointing portion.

The manner of unwithdrawable engagement between the two elements may obviously take various different forms. In a simple and preferred embodiment the first element is formed with an internal shoulder constituting the above mentioned abutment means, and the second element is formed with a mating external shoulder on a resiliently laterally depressible portion thereof which is depressed to insert the second element in the first and then automatically snaps into engagement with the shoulder on the first element once it has passed the latter. Preferably, the shoulder on the first element is annular and a pair of diametrically opposed mating shoulders are formed on the second element.

When the jointing portions are of the slot and tongue type already mentioned, said slot is preferably open at both ends for freedom of rotation of a tongue to be received in it, but it could, if desired, take the form of a slot-like recess with closed ends. Preferably the slot is formed in a substantially ball-shaped terminal portion of its associated element, preferably extending diametrically of the ball and substantially parallel to the length of the element. The tongue is preferably disc-shaped. Preferably the tongue is formed with two oppositely extending pins or projections and the opposite walls of the slot have corresponding holes or recesses to receive the same, thus, dispensing with a separate pivot pin.

The invention further provides a limb member for a toy figure incorporating a skeletal structure as already set forth, as well as a toy figure incorporating one or more such limb members. In one toy figure according to the invention, each upper arm, each fore-arm, and each lower leg are formed by such limb members.

The present invention is also concerned with the provision of an improved hip joint for a toy figure.

It is well known to provide a ball joint at the hip of a toy figure. In one known arrangement a part-spherical surface is formed on the upper end of each upper leg member and is rotatably received in a mating recess in the torso. In another arrangement a whole sphere is interposed between mating recesses in the torso and the top of the upper leg member. In both cases, the parts are held together by an elastic member secured internally of the torso and internally of the leg member. A disadvantage of these earlier proposals is that when the figure is put in a sitting position, the legs tend to splay apart into an un-natural posture, under the tension of the elastic member.

The present invention also provides an improved hip joint for a toy figure which comprises an upper leg member provided with a hollow part-spherical top end portion formed with an elongate slot in its wall and, either in or for incorporation in the bottom of the torso, a leg mounting member or spider comprising an elongate connecting element or arm which extends through said slot and is movable along the slot to permit swinging movement of the leg member relative to the torso, and a mounting element carried by said connecting element and having a part-spherical surface which makes a rotary sliding fit inside said top end portion of the leg member for rotation of the leg member relative to the torso.

Preferably, the said top end portion of the upper leg member comprises a terminal hemispherical portion formed with the said slot and rotatably mounted on the leg member for rotation about the longitudinal axis of the latter. Preferably, the said slot extends in a plane containing said longitudinal axis. Preferably, the slot extends over an arc of about 90° downwardly from the top end of the leg member. Preferably, the said mounting element is substantially disc-shaped with a part-spherical edge element. Preferably, the said leg mounting member comprises a unitary member for mounting both legs of the toy figure, comprising two of said connecting and mounting elements or arms, adapted to be secured in the torso.

The invention further extends to a toy figure having hip joints as set forth above, with or without limb members in accordance with the other aspects of the invention previously described.

An embodiment of the invention, together with a modification, will now be described by way of example and with reference to the accompanying drawings, in which.

Figure 1:
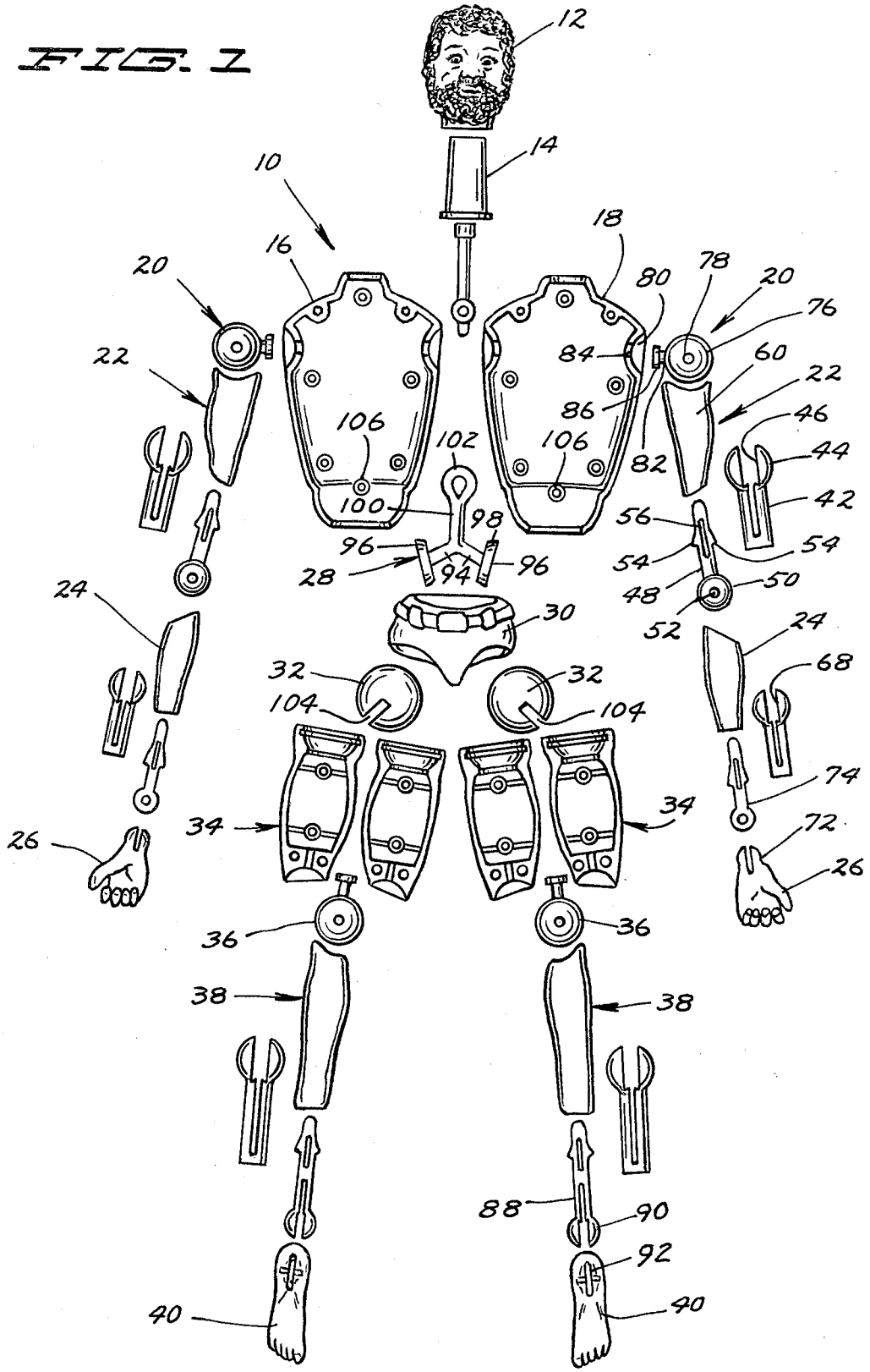
FIG. 1 is an exploded view which illustrates a toy figure embodying the features of the invention.
Figure 2:
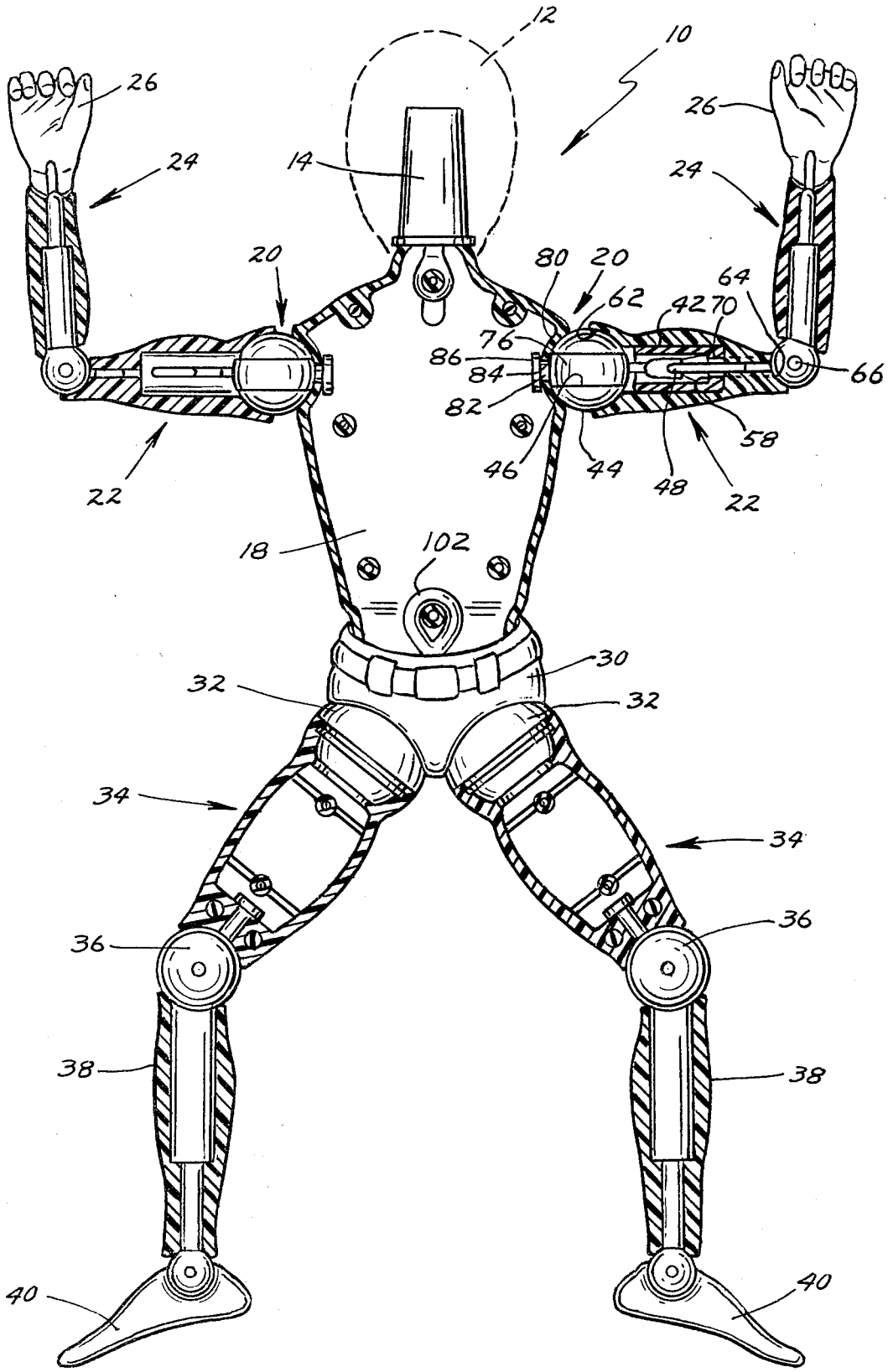
FIG. 2 is a vertical sectional view of the invention which depicts the toy figure in assembled condition.
Figure 3:
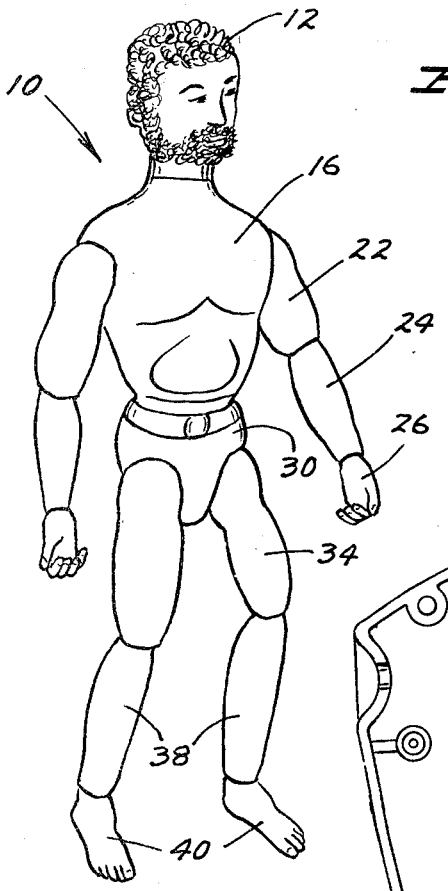
FIG. 3 is a perspective view of the toy figure in assembled condition.

Reference is now made to FIGS. 1 and 2 of the drawings, which illustrate a toy figure or doll designated generally by numeral 10. The doll includes a head 12, a neck assembly 14, front and rear torso shells 16 and 18, two shoulder elements 20, two upper arm assemblies 22, two forearm assemblies 24, two hands 26, a leg mounting member 28, trunks 30, two hip joint elements 32, two pairs of upper leg shells 34, two knee elements 36, two lower leg assemblies 38, and two feet 40.

The head, the neck assembly, and the torso shells do not themselves form part of the present invention and will not therefore be described in any further detail.

Each of the upper arm assemblies 22, each of the forearm assemblies 24, and each of the lower leg assemblies 38, include a limb member incorporating a skeletal structure in accordance with the invention. The assemblies 22 and 24 are substantially identical in structure; the assemblies 38 differ only in that a portion of the skeletal structure is formed with a slot rather than a tongue.

Reference is made to one of the upper arm assemblies 22 by way of example. This assembly comprises a skeletal structure comprising a first elongate tubular member or element 42 having first and second ends, and a second element 48 having first and second ends. A slotted portion in the form of a ball or spherical member 44 formed with a slot 46 is formed at a first end thereof and a bore 70 is formed in the second end. The second elongate element 48 carries a tongue in the form of a disc 50 provided with a pair of axial pins or projections 52. The second element 48 is formed with two shoulders 54 and a central slot 56 whereby the shoulders 54 are resiliently depressible inwardly. This enables the first end of the element 48 to be inserted through the bore 70 in the second end of the tubular element 42 so that the shoulders 54 snap behind an annular shoulder 58 (see FIG. 2) in the element 42, thus preventing withdrawal of the element 48 whilst permitting relative rotation. The limb assembly 22 is completed by an outer shell 60 formed to resemble the outward shape of the upper arm, into which shell the element 42 is inserted before the element 48 is engaged with it. The shell 60 is formed with terminal cup-like portions 62 and 64 which frictionally engage the ball 44 and the disc 50 respectively, to assist in maintaining the limb member in a desired position.

Each forearm assembly in substantially the same way, and is connected to the upper arm assembly 22 by snapping the pins 52 into holes or bores 66 (FIG. 2) in the opposite side walls of the slot 68 of the forearm. The hand 26 is formed with a slotted ball-shaped member 72 at the wrist for connection to the forearm in the same manner, i.e., by engaging the end of the element 74.

The shoulder element 20 comprises a disc 76 formed with pins 78 for engagement in holes or bores (not shown) in the slot 46 in the ball 44 of the upper arm element 42, the disc 76 being rotatably mounted in a shoulder recess or socket 80. The discs make a fairly tight friction fit in their respective slots, so as to assist in maintaining the limb members in desired positions. The shoulder 20 is movably mounted within the socket 80 with respect to the torso, by means of a shaft 82 which projects through a bore 84, and a disc 86 attached to the end of the shaft 82.

In the case of the lower leg assemblies 38, each of the elements 88 terminates in a slotted ball 90 rather than a disc, the feet being formed with discs 92 for connection thereto. The knee element 36 is substantially similar to the shoulder element 20 and will not be described in any further detail.

Figure 4:
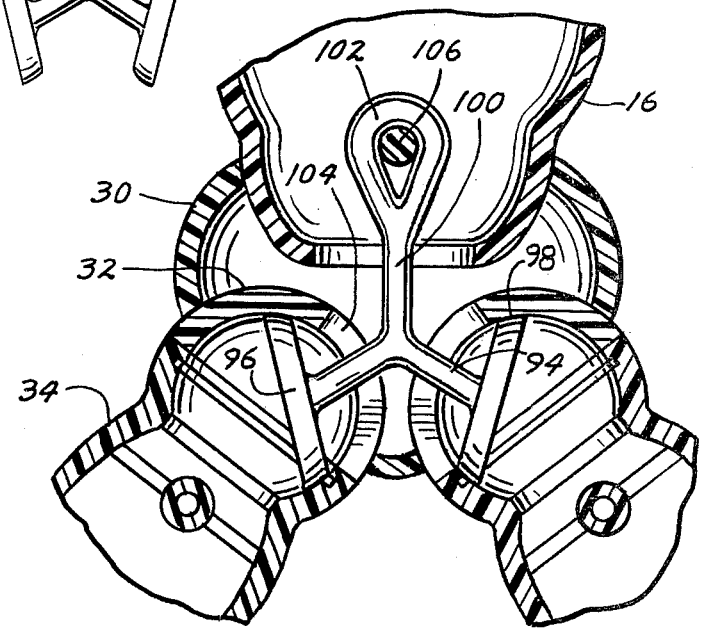
FIG. 4 is a partial sectional view which illustrates the hip connection for the toy figure.

The hip joint comprises the Y-shaped leg mounting member or spider 28 which includes two elongate connecting arms 94 integrally connected to a shaft 100 having a ring 102 attached thereto. Each arm carries a disc-like mounting element 96. The elements 96 are formed with a part-spherical edge surface 98 which is rotatably received in the hollow interior of the hemispherical hip joint element 32 which forms the rotatable top of the respective upper leg member; in this regard, note FIG. 4. Each hemisphere is formed with a slot 104 through which a connecting arm 94 extends. The spider 28 is mounted by means of the ring 102 which encircles pins 106 in the torso shell. The hemispherical elements 32 are secured to the top end of the upper legs 34 by appropriate means so that they are rotatable relative to the leg member, i.e., about the longitudinal axis of the latter.

Figure 5:
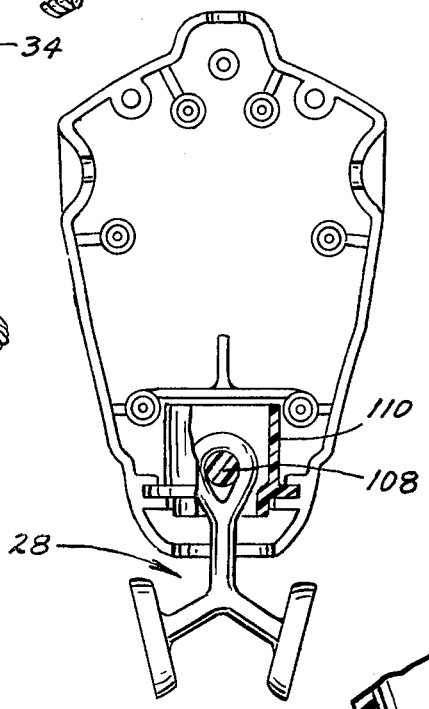
FIG. 5 is a sectional view of the torso illustrating a modification.

In a modification shown in FIG. 5, the spider 28 is mounted on a pin 108 rotatably confined in a substantially cylindrical shell 110 mounted in the torso so as to provide unlimited rotation of the trunks 30 and the legs relative to the torso.

While it is envisioned that a variety of materials might be used in producing the doll, it is preferred that the parts be moulded from suitable hardwearing plastics materials such as polythene and nylon.

In the above description and attached drawings, a disclosure of the principles of the invention is presented, together with some of the specific embodiments by which the invention might be carried out.

The embodiments of the invention in which an exclusive property or privilege is claimed are defined as follows:

1. An articulated toy figure having a torso and at least one limb member connected to said torso for movement relative thereto, a skeletal structure for said limb member, said skeletal structure comprising first and second elements, said first element including an elongate tubular member having first and second ends, a first jointing portion formed at a first end thereof, said first jointing portion including a slot whose general plane is parallel to the length of said first element, for the rotatable reception of another jointing portion in the form of a tongue, said first jointing portion being substantially ball-shaped with a diametric slot, said second element including an elongate member a first end of which is insertable into the second end of the tubular member, said elongate member being axially rotatable relative to said tubular member, means for preventing said second element from being withdrawable relative to said tubular member, and a second jointing portion being formed at the second end of said second element, said second jointing portion on said second element being a tongue whose general plane is parallel to the length of the element, for rotatable reception in a slot of another jointing portion, said tongue being disc-shaped and having a pair of oppositely extending axial pivot pins for rotatable reception in complementary apertures in the opposite walls of said slot.

2. An articulated toy figure having a torso and at least one limb member connected to said torso for movement relative thereto, a skeletal structure for said limb member, said skeletal structure comprising first and second elements, said first element including an elongate tubular member having first and second ends, a first jointing portion formed at a first end thereof, said second element including an elongate member a first end of which is insertable into the second end of the tubular member, said elongate member being axially rotatable relative to said tubular member, means for preventing said second element from being withdrawable relative to said tubular member, a second jointing portion being formed at the second end of said second element, at least one upper leg member and means for connecting said leg member to the bottom portion of the torso for swinging movement relative thereto, said leg member provided with a hollow part-spherical top end portion formed with an elongate slot in its wall, said connecting means including a Y-shaped leg mounting member having a pair of elongate connecting arms, a mounting element carried by each connecting arm, one of said arms extending through the elongated slot and being movable along said slot to permit swinging movement of the leg member relative to the torso, said mounting element having a part-spherical surface and being positioned within the part-spherical end portion of the leg member whereby said part-spherical surface makes a rotary sliding fit inside said end portion of the leg member, and means for mounting said Y-shaped leg mounting member within the lower portion of the torso.

3. An articulated toy figure having a torso and at least one limb member connected to said torso for movement relative thereto, a skeletal structure for said limb member, said skeletal structure comprising first and second elements, said first element including an elongate tubular member having first and second ends, a first jointing portion formed at a first end thereof, said second element including an elongate member a first end of which is insertable into the second end of the tubular member, said elongate member being axially rotatable relative to said tubular member, means for preventing said second element from being withdrawable relative to said tubular member, a second jointing portion being formed at the second end of said second element, a trunk portion, means for positioning a lower portion of the torso within said trunk portion, at least one leg member and means for connecting said leg member to said trunk portion for movement relative thereto, said connecting means including a leg mounting member having at least one elongate connecting arm, means for mounting said leg mounting member within the lower portion of the torso, said elongate connecting arm provided with means for engaging the upper portion of said leg member whereby said leg member is swingably connected to said torso.

4. A hip joint for a toy figure having a torso comprising an upper leg member and means for connecting said leg member to said torso for swinging movement relative thereto, said leg member provided with a hollow part-spherical top end portion formed with an elongate slot in its wall, said top end portion of said upper leg member comprising a terminal hemispherical portion formed with said slot, said portion being rotatably mounted on the leg member for rotation about the longitudinal axis of the latter, said slot extending in a plane containing said longitudinal axis, and said slot extending over an arc of about 90° downwardly from the top end of said leg member, said connecting means including a Y-shaped spider having a pair of elongate connecting arms, a mounting element carried by each connecting arm, one of said arms extending through the elongated slot and being movable along said slot to permit swinging movement of the leg member relative to the torso, said mounting element being substantially disc-shaped with a part-spherical edge surface and being positioned within the part-spherical end portion whereby said part-spherical edge surface makes a rotary sliding fit inside said end portion of the leg member, and means for mounting said Y-shaped spider within the lower portion of the torso.

5. A hip joint for a toy figure having a torso comprising an upper leg member and means for connecting said leg member to said torso for swinging movement relative thereto, said leg member provided with a hollow part-spherical top end portion formed with an elongate slot in its wall, said connecting means including a Y-shaped spider having a pair of elongate connecting arms, a mounting element carried by each connecting arm, one of said arms extending through the elongated slot and being movable along said slot to permit swinging movement of the leg member relative to the torso, said mounting element having a part-spherical surface and being positioned within the part-spherical end portion whereby said part-spherical surface makes a rotary sliding fit inside said end portion of the leg member, a